US010267473B2

(12) United States Patent
Park

(10) Patent No.: US 10,267,473 B2
(45) Date of Patent: Apr. 23, 2019

(54) LIGHTING DEVICE FOR VEHICLE HAVING A REFLECTIVE FLUORESCENT BODY AND PRISM

(71) Applicant: LG ELECTRONICS INC., Seoul (KR)

(72) Inventor: Soyeon Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/622,818

(22) Filed: Jun. 14, 2017

(65) Prior Publication Data

US 2017/0356614 A1 Dec. 14, 2017

(30) Foreign Application Priority Data

Jun. 14, 2016 (KR) ..... 10-2016-0074115

(51) Int. Cl.

| | |
|---|---|
| ***F21S 41/16*** | (2018.01) |
| ***F21S 41/141*** | (2018.01) |
| ***F21S 41/20*** | (2018.01) |
| ***F21S 41/25*** | (2018.01) |
| ***F21S 41/255*** | (2018.01) |
| ***F21S 41/32*** | (2018.01) |
| ***F21S 45/47*** | (2018.01) |

(52) U.S. Cl.

CPC ..... *F21S 41/16* (2018.01); *F21S 41/141* (2018.01); *F21S 41/25* (2018.01); *F21S 41/255* (2018.01); *F21S 41/285* (2018.01); *F21S 41/32* (2018.01); *F21S 45/47* (2018.01)

(58) Field of Classification Search

CPC ..... F21S 41/24; F21S 41/25; F21S 41/16
See application file for complete search history.

(56) References Cited

U.S. PATENT DOCUMENTS

| | | | | |
|---|---|---|---|---|
| 9,228,710 | B2 * | 1/2016 | Takahashi | F21S 41/14 |
| 2004/0208019 | A1 * | 10/2004 | Koizumi | B60Q 1/0041 362/545 |
| 2014/0321148 | A1 * | 10/2014 | Bauer | F21S 48/1145 362/516 |

(Continued)

FOREIGN PATENT DOCUMENTS

| | | |
|---|---|---|
| DE | 102012211915 | 1/2014 |
| DE | 102014205606 | 10/2015 |

(Continued)

OTHER PUBLICATIONS

Extended European Search Report in European Application No. 17173453.6, dated Nov. 27, 2017, 9 pages.

*Primary Examiner* — Robert J May
(74) *Attorney, Agent, or Firm* — Fish & Richardson P.C.

(57) ABSTRACT

A lighting device for a vehicle includes a lens; a prism that is disposed on a rear side of the lens and that is configured to totally reflect an incident light and to then emit the light; a light source device configured to emit light toward the prism; and a reflective fluorescent body disposed on the rear side of the lens and configured to convert a wavelength of light emitted by the prism and to then reflect the wavelength-converted light to the lens. The prism includes an emitting surface that is spaced apart from an optical axis of the lens. A distance between the reflective fluorescent body and a rear surface of the lens is greater than a distance between the emitting surface of the prism and the rear surface of the lens.

12 Claims, 4 Drawing Sheets

(56) References Cited

U.S. PATENT DOCUMENTS

| | | | |
|---|---|---|---|
| 2015/0049457 | A1 | 2/2015 | Kroell |
| 2015/0375672 | A1 | 12/2015 | Takahashi |

FOREIGN PATENT DOCUMENTS

| | | |
|---|---|---|
| JP | 2014178464 | 9/2014 |
| JP | 2015184303 | 10/2015 |
| KR | 10-2011-0022720 | 3/2011 |
| KR | 10-2016-0012470 | 2/2016 |
| WO | 2015076203 | 5/2015 |

* cited by examiner

LIGHTING DEVICE FOR VEHICLE HAVING A REFLECTIVE FLUORESCENT BODY AND PRISM

CROSS-REFERENCE TO RELATED APPLICATIONS

The present application claims the benefit of an earlier filing date and right of priority under 35 U.S.C. 119 and 35 U.S.C. 365 to Korean Patent Application No. 10-2016-0074115 filed on Jun. 14, 2016, the contents of which are hereby incorporated by reference in their entirety.

TECHNICAL FIELD

The present disclosure relates to a lighting device for a vehicle.

BACKGROUND

Vehicles typically implement lighting devices, such as lamps, which facilitate a driver's visibility or inform those outside the vehicle of a current running state of the vehicle. Such lighting devices increase the intensity of illumination of surroundings of the vehicle during operation of the vehicle.

A lighting device for a vehicle installed in the vehicle, hereinafter referred to simply as "a lighting device for a vehicle" may be implemented as a head lamp that irradiates light to a front of the vehicle or a rear lamp that displays information such as a heading direction of the vehicle, a state of a braking operation of the vehicle, or the like.

A lighting device for a vehicle is typically configured to form a low beam or a high beam for securing visibility of a driver. For example, some vehicles implement a lighting device with a light source as an LED which has a high power efficiency and a long service life. As another example, some vehicles implement a lighting device with a light source as a laser diode having a longer irradiation distance than the LED as a light source.

SUMMARY

Implementations are disclosed herein that provide a lighting device for a vehicle.

In one aspect, a lighting device for a vehicle may include a lens; a prism that is disposed on a rear side of the lens and that is configured to totally reflect an incident light and to then emit the light; a light source device configured to emit light toward the prism; and a reflective fluorescent body. The reflective fluorescent body may be disposed on the rear side of the lens and may be configured to convert a wavelength of light emitted by the prism and to then reflect the wavelength-converted light to the lens. The prism may include an emitting surface that is spaced apart from an optical axis of the lens. A distance between the reflective fluorescent body and a rear surface of the lens may be greater than a distance between the emitting surface of the prism and the rear surface of the lens.

In some implementations, the reflective fluorescent body may be disposed to face the rear surface of the lens and may be configured to reflect the light toward the rear surface of the lens.

In some implementations, the reflective fluorescent body may be disposed on the optical axis of the lens.

In some implementations, at least one portion of the prism may be disposed between the reflective fluorescent body and the lens.

In some implementations, a sectional surface of the prism may have a circular shape.

In some implementations, a sectional surface of the prism may have a polygonal shape having at least one pair of parallel sides.

In some implementations, the prism may have a length that is configured for the prism to totally reflect, a plural number of times, light that is incident on the prism.

In some implementations, the prism may include: an incident surface on which light is incident; and an emitting surface from which light is emitted.

In some implementations, the incident surface may be perpendicular to the rear surface of the lens.

In some implementations, the emitting surface may be perpendicular to the rear surface of the lens.

In some implementations, the incident surface and the emitting surface may be parallel to each other.

In some implementations, the lighting device may further include a convex lens configured to condense light, the convex lens provided on at least one surface of the incident surface and the emitting surface.

In some implementations, the lighting device may further include an anti-reflection (AR) coating on at least one surface of the incident surface and the emitting surface.

In some implementations, a distance between the optical axis of the lens and the emitting surface may be less than or equal to a radius of the rear surface of the lens.

The details of one or more implementations are set forth in the accompanying drawings and the description below. Other features will be apparent from the description and drawings, and from the claims. The description and specific examples below are given by way of illustration only, and various changes and modifications will be apparent.

DETAILED DESCRIPTION

Figure 1:
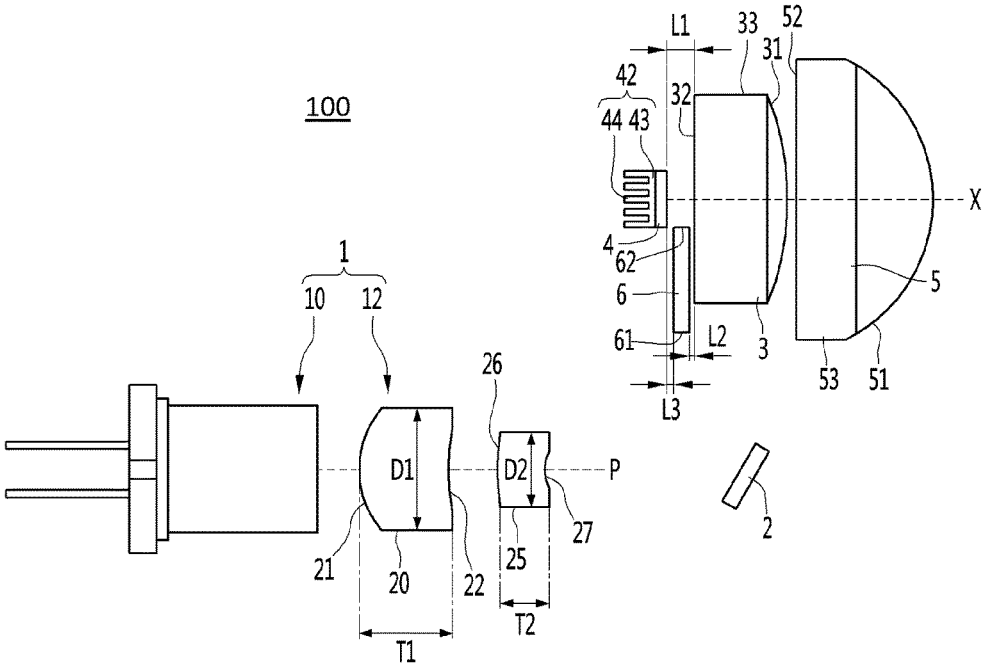
FIG. 1 is diagram illustrating an example of a lighting device for a vehicle according to an implementation.

The present disclosure relates to a lighting device for a vehicle, and more specifically to a lighting device for a vehicle that implements reflective components that perform at least one reflection of light irradiated from a light source, and then projects the light to an outside of the vehicle.

According to some implementations, light from a light source is reduced by a light reducer, before being incident on a prism, and then being reflected into a reflective fluorescent body that reflects the light through a lens. As such, the size of the lens may be reduced and the lens may be made more compact. In addition, the prism may have a structure that is simplified, and the number of the components in the lighting device may be reduced and the lens may be made more compact.

Hereinafter, some examples of implementations will be described in detail with reference to the drawing.

Figure 2:
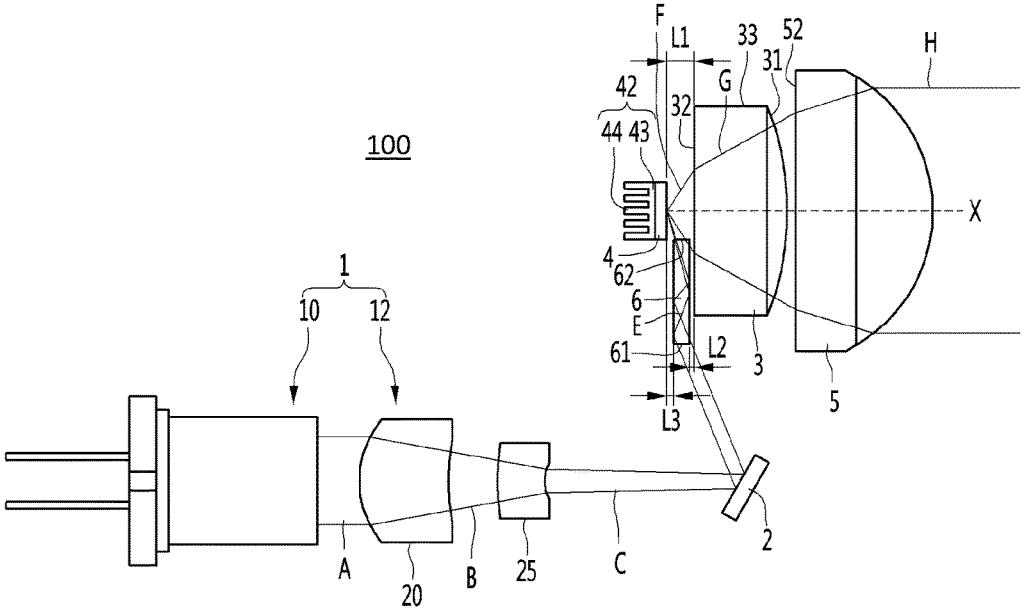
FIG. 2 is a diagram illustrating an example of an optical path of a lighting device for a vehicle according to an implementation.
Figure 3:
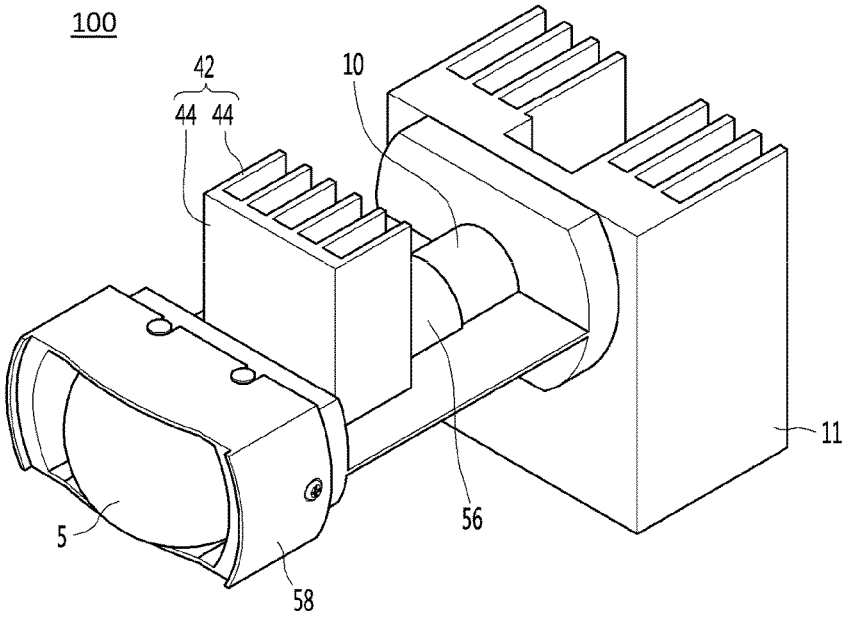
FIG. 3 is a diagram illustrating an example of a lighting device for a vehicle according to an implementation.
Figure 4:
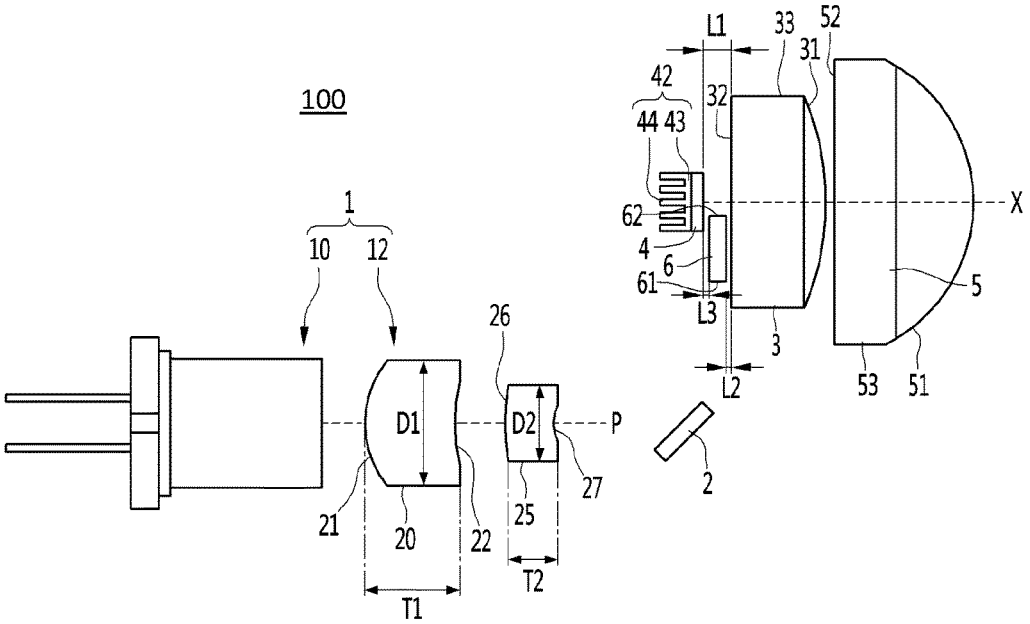
FIG. 4 is a diagram illustrating an example of a lighting device for a vehicle according to another implementation.
Figure 5:
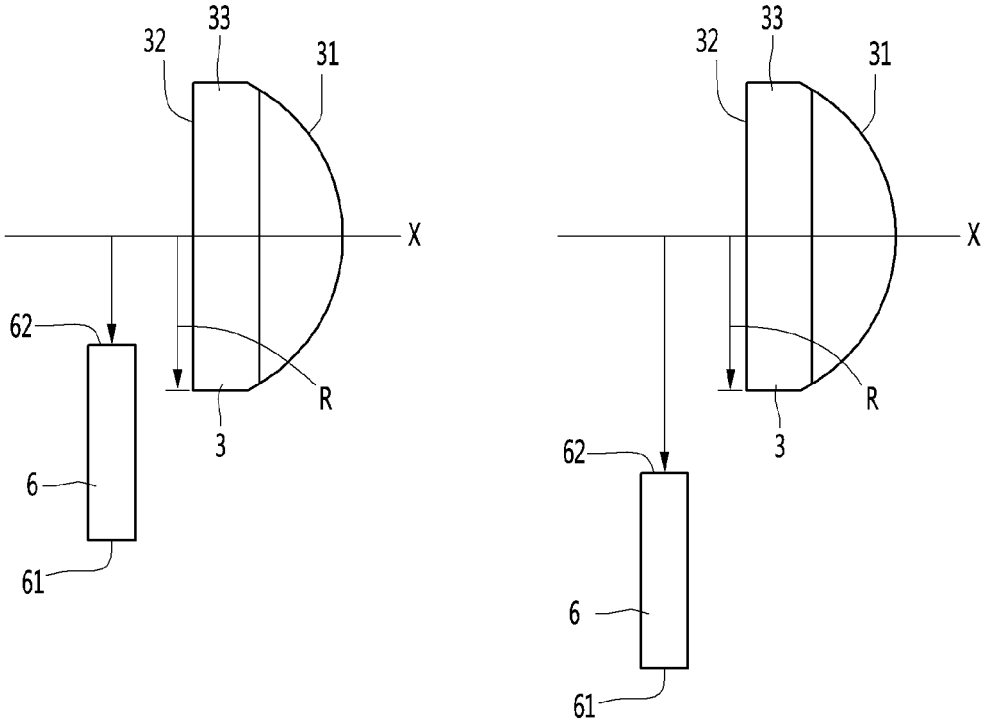
FIG. 5 is a diagram illustrating two examples of a position relationship between a lens and a prism according to another implementation.
Figure 6:
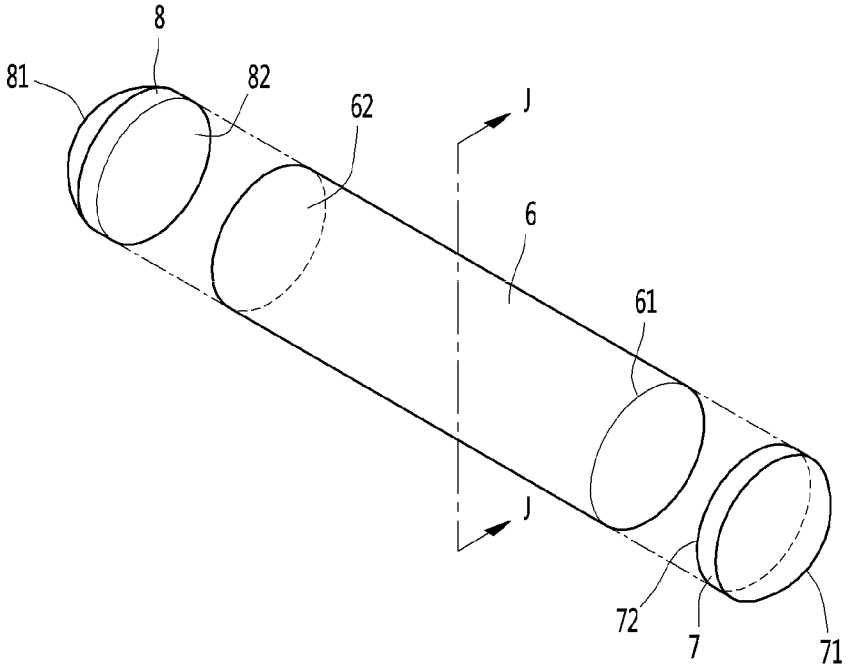
FIG. 6 is a diagram illustrating an example of the prism and a condensing lens according to an implementation.
Figure 7:
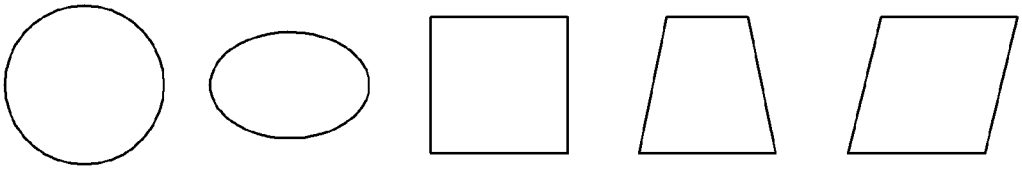
FIG. 7 is a diagram illustrating the prism in FIG. 6.

FIG. 1 is a diagram illustrating an example of a lighting device for a vehicle according to some implementations. FIG. 2 is a diagram illustrating an example of an optical path of the lighting device for a vehicle according to some implementations. FIG. 3 is a diagram illustrating a perspective view of an example of the lighting device for a vehicle according to some implementations. FIG. 4 is a diagram illustrating an example of a lighting device for a vehicle according to another implementation. FIG. 5 is a diagram illustrating two examples of a position relationship between a lens and a prism according to another implementation. FIG. 6 is a diagram of a perspective view illustrating an example of the prism and a condensing lens according to some implementations. FIG. 7 is a diagram of a cross-sectional view illustrating an example of the prism in FIG. 6.

In some implementations, the lighting device for a vehicle may constitute a head lamp of the vehicle and may be used as a high beam lighting device which generates a high beam or may be used as a low beam lighting device which generates a low beam.

In the examples of FIGS. 1 to 3, the lighting device 100 for a vehicle includes a light source device 1, a reflecting unit 2, a prism 6, a lens 3, and a reflective fluorescent body 4.

The light source device 1 is capable of emitting light toward the prism 6.

The light source device 1 is configured to emit light toward the reflecting unit 2. For example, as shown in FIGS. 1 and 2, the light that is incident on the reflecting unit 2 is reflected from the reflecting unit 2 and is incident on the prism 6.

The light source device 1 may include a light source 10 that emits light, and the light reducer 12 that reduces a size of the light emitted from the light source 10. The light source 10 may receive electric energy and then may convert the electric energy into light energy, for example using a light emitting source such as an ultra high pressure mercury lamp (UHV Lamp), a light emission diode (LED), or a laser diode.

The light source 10 may be a light source which is configured to be irradiated with light from a long distance while having an excellent feature of straightness and high efficiency. In some implementations, the light source 10 preferably is a laser diode. For example, the laser source 10 may be a laser diode which irradiates with a blue based laser light having high efficiency.

The light source device 1 may further include a light reducer, such as light reducer 12 in FIGS. 1 and 2. The light reduce 12 may be configured to reduce the size of the light emitted from the light source 10 and then emit the reduced-size light toward the reflecting unit 2. As such, the beam emitted from the light source 10 may pass through the light reducer 12 and then may be emitted toward the reflecting unit 2. Further details of the light reducer 12 will be described below.

As shown in the examples of FIGS. 1 and 2, the lighting device 100 may also include a reflective fluorescent body 4, which may be configured to convert a wavelength of incident light and emit wavelength-converted light. For example, as shown in FIG. 2, light that is reflected from the reflecting unit 2 may be incident on the reflective fluorescent body 4, which may convert a wavelength of the incident light and emit wavelength-converted light towards the lens 3.

In some implementations, the lens 3 may have a larger size than the size of the reflective fluorescent body 4 and the reflecting unit 2. As such, the lens 3 may be configured to protect the reflective fluorescent body 4 and the reflecting unit 2 at the front side of the reflective fluorescent body 4.

The lens 3 may have, for example, a cylindrical shape or polygonal pillar shape. The lens 3 may include a front surface 31, a rear surface 32, and a peripheral surface 33, as illustrated in FIGS. 1 and 2.

The front surface 31 of the lens 3 may have a convex curved surface toward the front side. The rear surface 32 of the lens 3 may have a flat surface or a recessed curved surface toward the front side.

The lens 3 may have an optical axis X. The front surface of the lens 3 may be a convex condensing lens may be symmetrical about the optical axis X. As shown in FIGS. 1 and 2, the optical axis X of the lens 3 may be a rotational symmetrical axis or a center axis and may refer to a straight line which passes through the centers of the front surface 31 and the rear surface 32 of the lens 3.

The lighting device 100 for a vehicle further including a projection lens 5 disposed on the front side of the lens 3, as shown in FIGS. 1 to 3.

The projection lens 5 may have a greater size than the size of the lens 3. The optical axis of the projection lens 5 may be matched and aligned with the optical axis X of the lens 3.

The projection lens 5 may include a front surface 51, a rear surface 52, and a peripheral surface 53. The front surface 51 of the projection lens 5 may be a convex surface toward the front side. The rear surface 52 of the projection lens 5 may be a flat surface. The projection lens 5 may have a symmetrical structure about the optical axis.

The reflective fluorescent body 4 may be disposed on the rear side of the lens 3 and may convert a wavelength of the light reflected at the reflecting unit 2 and then reflect the wavelength-converted light to the lens 3.

In some implementations, the reflective fluorescent body 4 may be arranged to be spaced apart from the lens 3. For example, as shown in FIGS. 1 and 2, the reflective fluorescent body 4 may be disposed on a rear side of the lens 3 to be spaced apart from the lens 3. As such, in some scenarios, heat that is generated at the reflective fluorescent body 4 during wavelength conversion of light may be mitigated from affecting the lens 3.

As shown in FIGS. 1 and 2, in some implementations, the reflective fluorescent body 4 may be disposed to face the rear surface 32 of the lens 3 and may reflect light toward the rear surface 32 of the lens 3. In some implementations, the front surface of the reflective fluorescent body 4 may be parallel to the rear surface 32 of the lens 3.

The reflective fluorescent body 4 may be disposed on the optical axis X of the lens 3, so that the center of the reflective fluorescent body 4 is aligned with the optical axis X of lens 3. However, implementations are not limited thereto.

In some scenarios, the reflective fluorescent body 4 may be eccentrically disposed with respect to the optical axis X of the lens 3, so as not to be aligned with the optical axis X of the lens 3. However, in such scenarios, the lighting efficiency may be reduced because an area of the lens 3 through which light reflected from the reflective fluorescent body 4 is transmitted may be smaller than the area as compared with scenarios where the reflective fluorescent body 4 is aligned with the optical axis X of the lens 3.

Further, in a case where the reflective fluorescent body 4 is disposed to be eccentric with respect to the optical axis X of the lens 3, the area through which light reflected from the reflective fluorescent body 4 is transmitted may be asymmetrical with respect to the other area in the projection lens 5. In this case, the manufacturing process of the projection lens 5 may be more complicated and thus the manufacturing cost of the projection lens 5 may be increased.

By contrast, in implementations where the reflective fluorescent body 4 is disposed and aligned with the optical axis X of the lens 3, the projection lens 5 may be formed to be symmetrical about the optical axis X, and thus the manufacturing cost of the projection lens 5 may be reduced.

As such, in some implementations, the reflective fluorescent body 4 is preferably disposed to the optical axis X of the lens 3, so that the center of the reflective fluorescent body 4 is aligned on the optical axis X of the lens 3, as shown in the examples of FIGS. 1 and 2.

The reflective fluorescent body 4 may include a wavelength conversion layer which faces the rear surface 32 of the lens 3. The reflective fluorescent body 4 may also include a reflecting unit which is disposed on the rear side of the wavelength conversion layer.

The wavelength conversion layer may include a wave conversion film and may include an opto-ceramic material. The wavelength conversion layer is configured to convert the wavelength of the light reflected at the reflecting unit 2 in a state of being positioned at the front side of the reflecting unit. For example, if blue-based light is incident on the wavelength conversion layer from the outside, the wavelength conversion layer may include a wavelength conversion film that converts the blue-based light into yellow-based light. The wavelength conversion layer may include an opto ceramic having yellow color. However, the wavelength conversion properties are not limited to these specific colors, and the wavelength conversion layer may be configured to convert between any suitable wavelengths of light.

The reflecting unit may include a plate and a reflecting coating layer which is coated the outside surface of the plate. The plate may be, in some implementations, made of a metal. The reflecting unit may support the wavelength conversion layer and light transmitted through the wavelength conversion layer may be reflected toward the rear surface 32 of the lens 3 by the reflecting unit.

If blue-based light is incident on the reflective fluorescent body 4 through the prism 6, a portion of the blue based light is surface-reflected and the light which is incident on the inner portion of the wavelength conversion layer of the blue based light is configured to be excited in the inner portion of the wavelength conversion layer and the light may be reflected to the front side of the wavelength conversion layer by the reflecting unit.

The blue based light which is surface-reflected from the surface of the wavelength conversion layer and yellow based light which is emitted to the front side of the wavelength conversion layer may be mixed and white based light is emitted to the front side of the front surface of the reflective fluorescent body 4. This white based light may be transmitted through the lens 3 and may be emitted toward the front side of the lens 3.

A portion of the white based light emitted from the reflective fluorescent body 4 may be incident on the emitting surface 62 of the prism 6. The white based light emitted to the prism 6 may be, in some implementations, totally reflected from the inner portion of the prism 6, and then may be emitted to the incident surface 61 of the prism 6. In such scenarios, the efficiency of the light source device 1 may be reduced.

A distance L1 between the reflective fluorescent body 4 and the lens 3 may determine the width of the lighting device 100 for a vehicle in the longitudinal direction, and preferably, the reflective fluorescent body 4 is closely disposed to the lens 3 within the range in which the damage of the lens 3 by heat is mitigated.

The heat radiating member 42 which assists to radiate heat of the reflective fluorescent body 4 may be disposed in the reflective fluorescent body 4. The heat radiation member 42 may include a contact plate 43 which is in contact with the reflective fluorescent body 4, and a heat radiation fin 44 which is projected from the contact plate 43.

The contact plate 43 is attached to the rear surface of the reflecting unit to be surface-contacted.

The reflective fluorescent body 4 may have a lower optical efficiency than the transmissive fluorescent body. However, the structure for cooling fluorescent body may be easily implemented and the cooling efficiency may be high.

The reflecting unit 2 may be provided to reflect the incident light to the prism 6.

The prism 6 may include an incident surface 61 on which light is incident, and may also include an emitting surface 62 from which light is emitted.

If the reflecting unit 2 is not provided in the lighting device 100, the light emitted from the light source device 1 may be incident on the incident surface 61 of the prism 6.

If the reflecting unit 2 is provided in the lighting device 100, the light reflected from the reflecting unit 2 may be incident on the incident surface of the prism 6.

The light which is incident on the inner portion of the prism 6 through the incident surface 61 may be, in some implementations, totally reflected in the inner portion of the prism 6. As such, the total reflection may result in reflection without optical loss, or without substantial optical loss.

The total reflection may be generated in a configuration where an angle of light incident on the boundary surface is greater than a critical angle (e.g., according to Snell's law). The boundary surface may be a surface of the prism 6 and the refractive index of the prism 6 may be greater than the refractive index of the outside of the prism 6. For example, the outside of the prism 6 may be made of air, and the prism 6 may be made of a material having e refractive index which is greater than the refractive index of air.

In such configurations, the light that is incident on the incident surface 61 is totally reflected from the inner portion of the prism 6, and then may be emitted through the emitting surface 62. The light that is emitted through the emitting surface 62 of the prism 6 may be incident on the reflective fluorescent body 4.

The total reflection may occur in multiple instances on the inner portion of the prism 6. In some implementations, the number of occurrences of the total reflection may depend on, and vary according to, the length of the prism 6. Further, the number of occurrences of the total reflection may depend on, and may vary according to, the thickness of the prism 6. Further, the number of occurrences of the total reflection may depend on, and may vary according to, the incident angle of the light which is incident on the incident surface 61 of the prism 6. In some implementations, preferably, the incident angle of the light on the incident surface 61 of the prism 6 is greater than the critical angle at which total reflection occurs.

The reflecting unit 2 may be disposed in a front side relative to the rear surface of the lens 3, as illustrated in FIG.

1 and FIG. 2. In some implementations, the reflecting unit 2 may be disposed in a rear side relative to the rear surface of the lens 3, as illustrated in FIG. 4.

In some implementations, the incident angle of the light incident on the prism 6 may depend on the position at which the reflecting unit 2 is disposed, and may be changed. Further, the incident angle of the light incident on the prism 6 may depend on the angle between the incident light on the reflecting unit 2 and the reflecting surface of the reflecting unit 2, and this may also be changed. In either scenario, preferably, the incident angle of the light on the incident surface of the prism 6 is greater than the critical angle for occurring the total reflection.

The prism 6 may, in some implementations, have a rod shape. The incident surface 61 may be a first end of the prism 6, and the emitting surface 62 may be a second end thereof. The boundary surface on which the total reflection occurs may be a side surface or a perimeter surface.

In addition, the incident surface 61 may be one side surface of the prism 6, and the emitting surface 62 may be the other side surface thereof. The boundary surface on which the total reflection occurs may be a side surface or a perimeter surface.

The incident surface 61 of the prism 6 may have a flat surface. Further, the emitting surface 62 of the prism 6 may have a flat surface. Further, the incident surface 61 and the emitting surface 62 is positioned to be parallel to each other.

The prism 6 may be disposed on the rear side of the lens 3. Alternatively, the prism 6 may be disposed on the front side of the reflective fluorescent body 4. Alternatively, the prism 6 may be disposed between the rear surface of the lens 3 and the reflective fluorescent body 4.

The perimeter surface of the prism 6 may be in contact with the rear surface of the lens 3. Alternatively, the perimeter surface of the prism 6 may be spaced apart from the rear side of the lens 3. Further, the reflective fluorescent body 4 may be spaced apart from the perimeter surface of the prism 6.

The distance L1 between the reflective fluorescent body 4 and the lens 3 may be greater than the distance L2 between the prism 6 and the lens 3.

The distance L1 between the reflective fluorescent body 4 and the lens 3 may be greater than the distance L3 between the prism 6 and the reflective fluorescent body 4.

In some implementations, the incident surface 61 of the prism 6 is disposed to be perpendicular to the rear side of the lens 3. The emitting surface 62 of the prism 6 is disposed to be perpendicular to the rear surface of the lens 3.

The emitting surface 62 of the prism 6 may be positioned to include and overlap with the optical axis X of the lens 3.

The emitting surface 62 of the prism 6 may be positioned to be spaced apart from and not overlap with the optical axis X of the lens 3. The rear surface of the lens 3 may have a radius R.

The distance between the emitting surface 62 of the prism 6 and the optical axis X of the lens 3 may be smaller than the radius R of the rear surface of the lens 3. In some implementations, the distance between the emitting surface 62 of the prism 6 and the optical axis X of the lens 3 may be equal to the radius R of the rear surface of the lens 3. Alternatively, in some implementations, the distance between the emitting surface 62 of the prism 6 and the optical axis X of the lens 3 may be greater than the radius R of the rear surface of the lens 3.

According to the distance between the emitting surface 62 of the prism 6 and the optical axis X of the lens 3, the prism 6 may not be disposed between the reflective fluorescent body 4 and the lens 3.

According to the distance between the emitting surface 62 of the prism 6 and the optical axis X of the lens 3, a portion of the prism 6 may be disposed between the reflective fluorescent body 4 and the lens 3.

The incident surface 61 or the emitting surface 62 of the prism 6 may include a coating surface for increasing the light transmittance. The coating surface may be an anti-reflection coating surface.

The incident surface 61 of the prism 6 may include a first condensing lens 7 for condensing light. The front surface of the first condensing lens 7 may have a convex curved surface toward the front side and the rear surface thereof may have a flat surface. The incident surface 61 and the rear surface of the first condensing lens 7 may be adhered or bonded to each other. Alternatively, the prism 6 and the first condensing lens 7 may be integrally formed with each other. In this case, the incident surface 61 of the prism 6 and the rear surface of the first condensing lens 7 may be the same surface.

The first condensing lens 7 may serve to collect the light that is incident on from the prism 6. The light which is condensed through the first condensing lens 7 is not distributed or scattered and may be totally reflected in the inner portion of the prism 6.

The convex surface of the first condensing lens 7 may be an anti-reflection (AR) coating surface. Preferably, the reflection does not occur from the surface of the first condensing lens 7, since the first condensing lens 7 serves to collect the light to the inner portion of the prism 6.

The emitting surface 62 of the prism 6 may include a second condensing lens 8 for condensing light. The front surface of the second condensing lens 8 may have a convex curved surface toward the front side and the rear surface of the second condensing lens 8 may have a flat surface. The emitting surface 62 and the rear surface of the second condensing lens 8 may be adhered or bonded to each other. Alternatively, the prism 6 and the second condensing lens 8 may be integrally formed with each other. In this case, the emitting surface 62 of the prism 6 and the rear surface of the second condensing lens 8 may be the same surface.

The second condensing lens 8 may serve to collect the light that is emitted from the prism 6. The light which is condensed through the second condensing lens 8 is not distributed or scattered and may be emitted to the outside portion of the prism 6 and thus is incident on the reflective fluorescent body 4.

The convex surface of the second condensing lens 8 may be an anti-reflection (AR) coating surface. Preferably, the reflection does not occur from the second condensing lens 8, since the second condensing lens 8 serves to collect the light that is emitted to the outside portion of the prism (6).

FIG. 7 is a cross-sectional view taken along the line J-J of FIG. 6. The prism 6 may have various shapes including cross-sectional shapes illustrated in FIG. 7.

As illustrated in the examples of FIG. 7, the cross-section of the prism 6 may have, from left to right in FIG. 7, a circular shape, an oval shape, a rectangular shape, a trapezoid shape, or a parallelogram shape.

The inner portion of the prism 6 serves to allow the incident light to be totally reflected, and thus the prism 6 may have any shape if the shape of the prism 6 may be a shape which is capable of occurring the total reflection from the inner portion of the prism. Specifically, the cross-sectional shape of the prism 6 may have a polygonal shape which has a pair of sides which is parallel to each other.

The light reducer 12 may be disposed between the lens 3 and the light source 10. The light reducer 12 is disposed between the rear surface 32 of the lens 3 and the light source 10 to be spaced apart from the lens 3 and the front surface of the light source 10 respectively.

The light reducer 12 is spaced apart the optical axis X of the lens 3. A portion of the light reducer 12 may be positioned on the optical axis X of the lens 3. However, the optical axis P of the light reducer 12 is spaced apart from the optical axis X of the lens 3.

The light reducer 12 is disposed on the rear side of the lens 3 and emits light in the direction parallel to the optical axis X of the lens 3. The optical axis P of the light reducer 12 may be parallel to the optical axis X of the lens 3.

The light reducer 12 may include a first reducer lens 20 in which light width is reduced while the light emitted from the light source 10 transmits through the first reducer lens 20 and a second reducer lens 25 which is spaced apart from the first reducer lens 20 and in which light width is reduced while the light emitted from the first reducer lens 20 transmits through the second reducer lens 30.

The first reducer lens 20 has an incident surface 21 and an emitting surface 22 and the second reducer lens 25 has an incident surface 26 and an emitting surface 27.

The emitting surface 22 of the first reducer lens 20 and the incident surface 26 of the second reducer lens 25 is space apart from each other. The emitting surface 22 of the first reducer lens 20 and the incident surface 26 of the second reducer lens 25 may be space apart in the direction parallel to the optical axis X of the lens 3. The first reducer lens 20 and the second reducer lens 30 may be spaced apart with air having between the first reducer lens 20 and the second reducer lens 25.

The first reducer lens 20 and the second reducer lens 25 may be spaced apart in the longitudinal direction. The emitting surface 22 of the first reducer lens 20 and the incident surface 26 of the second reducer lens 25 is spaced apart in the longitudinal direction.

The first reducer lens 20 may be positioned between the light source 10 and the second reducer lens 25 and the second reducer lens 25 may be positioned between the first reducer lens 20 and the lens 3.

The incident surface 21 of the first reducer lens 20 may face the light source 10.

The optical axis P of the first reducer lens 20 and the optical axis of the second reducer lens 25 may be the same each other.

The emitting surface 27 of the second reducer lens 25 may face the rear surface 32 of the lens 3. Preferably, the emitting surface 27 of the second reducer lens 25 does not face a heat radiating member 42 or the reflective fluorescent body 4.

The incident surfaces, on which light is incident, of first reducer lens 20 and the second reducer lens 25 may have a convex shape. The emitting surfaces, from which light is emitted, of first reducer lens 20 and the second reducer lens 25 may have a concave shape.

The rear surface of the first reducer lens 20 may be the incident surface 21 and the incident surface 21 may have a convex curved surface toward the rear side. The light which is incident from the light source 10 may be refracted at the convex incident surface 21 and the width of the light which transmits through the first reducer lens 20 may be gradually reduced, as illustrated in FIG. 2.

The front surface of the first reducer lens 20 may be the emitting surface 22 and the emitting surface 22 may have a concave depression curved surface toward the rear side. The entire front surface of the first reducer lens 20 may have a concave depression emitting surface 22. Only the center portion of the front surface of the first reducer lens 20 may have the concave depression emitting surface 22.

A portion of the emitting surface 22 of the first reducer lens 20 may face the incident surface 26 of the second reducer lens 25.

The rear surface of the second reducer lens 25 may be the incident surface 26 and the incident surface 26 may have a convex curved surface toward the rear side. The light which is emitted from the first reducer lens 20 and then passes through the air between the first reducer lens 20 and the second reducer lens 25 may be refracted at the convex incident surface 26 of the second reducer lens, and the width of the light transmitted through the second reducer lens 25 may be gradually reduced.

The front surface of the second reducer lens 25 may be the emitting surface 27 and the emitting surface 27 may have a concave depression curved surface toward the rear side. The entire front surface of the second reducer lens 25 may have a concave depression emitting surface 27. Only the center portion of the front surface of the second reducer lens 25 may have the concave depression emitting surface 27.

The entire emitting surface 27 of the second reducer lens 25 may face the rear surface 32 of the lens 3.

The diameter D2 of the second reducer lens 25 may be smaller than the diameter D1 of the first reducer lens 20. The thickness T2 of the second reducer lens 25 may be smaller than the thickness T1 of the first reducer lens 20.

The size of the second reducer lens 25 may be smaller than the size of the first reducer lens 20 in order to increase the peripheral space utilization, since the light is primarily reduced at the first reducer lens 20.

The curvatures of the incident surface 21 of the first reducer lens 20 and the incident surface 26 of the second reducer lens 25 may be the same each other or may be different from each other.

The reduction degree of the width of the light which is transmitted through the first reducer lens 20 is highly dependent on the curvature of the incident surface 21 of the first reducer lens 20. The reduction degree of the width of the light which is transmitted through the first reducer lens 20 may be increased as the curvature of the incident surface 21 of the first reducer lens 20 is increased.

In other words, the second reducer lens 25, the sizes of the reflecting unit 2, and the lens 3 may be decreased as the curvature of the incident surface 21 of the first reducer lens 20 is increased.

The light of which width is primarily reduced at the first reducer lens 20 may be incident on the incident surface 26 of the second reducer lens 25 and the incident surface 26 of the second reducer lens 25 is preferably configured that the light is not excessively reduced.

In a case where the curvature of the incident surface 21 of the first reducer lens 20 and the curvature of the incident surface 26 of the second reducer lens 25 is different from each other, preferably, the curvature of the incident surface 21 of the first reducer lens 20 is greater than the curvature of the incident surface 26 of the second reducer lens 25.

The curvatures of the emitting surface 22 of the first reducer lens 20 and the emitting surface 27 of the second reducer lens 25 may be the same each other or may be different from each other.

The first reducer lens 20 is capable of differentiating the width of the light emitted from the first reducer lens 20 according to the curvature of the emitting surface 22.

The emitting surface 22 of the first reducer lens 20 may have a curvature which allows the light which passes through the emitting surface 22 to be emitted in parallel. Further, the emitting surface 22 of the first reducer lens 20 may have a curvature which allows the light passed through the emitting surface 22 to be gradually reduced between the emitting surface 22 of the first reducer lens 20 and the incident surface 26 of the second reducer lens 25.

Preferably, the second reducer lens 25 is configured that the width of the light which is incident on the reflecting unit 2 may be different from each other according to the curvature of the emitting surface and the emitting surface 27 of the second reducer lens 25 is configured that the light passed through the emitting surface 27 is incident on the reflecting unit 2 in parallel.

In a case where the curvature of the emitting surface 22 of the first reducer lens 20 and the curvature of the emitting surface 27 of the second reducer lens 25 is different from each other, preferably, the curvature of the emitting surface 27 of the second reducer lens 25 is greater than the curvature of the emitting surface 22 of the first reducer lens 20.

Meanwhile, the lighting device for a vehicle may further include a light reducer supporter 56 (see FIG. 3) supporting the light reducer 12.

The light reducer supporter 56 has a shape surrounding the light reducer 12. The light reducer supporter 56 may be lengthened in the direction parallel to the optical axis X of the lens 3 and may have a light transmitting path through which light transmits in the inner portion thereof.

Further, the lighting device for a vehicle may further include a lens holder 58 which supports the lens 3 and the projection lens 5.

In some implementations, the lighting device may also include a heat radiation member 11, as shown in FIG. 3, which radiates heat generated in the light source 10. The heat radiation member 11 may include a contact plate which is in contact with the light source 10 and a heat radiation fin which is projected from the contact plate.

Hereinafter, an operation of implementations having the configuration described above will be described as follow: Hereinafter, with reference to FIG. 2, it is described that the light source 10 emits the blue based light and the reflective fluorescent body 4 converts the wavelength of the blue based light into the wavelength of the yellow based light, for example.

First, when the light source 10 turns on, the blue based light A may be emitted from the light source 10 and the light A emitted from the light source 10 may be incident on the light reducer 12 in parallel.

The light A emitted from the light source 10 in parallel may be incident on the incident surface 21 of the first reducer lens 20, may refract at the incident surface 21 of the first reducer lens 20 and then the width of the light may be reduced.

The light refracted at the emitting surface 22 of the first reducer lens 20 may transmit through the first reducer lens 20 and thus may be emitted to the emitting surface 22 of the first reducer lens 20.

The light B emitted to the emitting surface 22 of the first reducer lens 20 is incident on the incident surface 26 of the second reducer lens 25 in parallel or the width of the light B is gradually reduced between the emitting surface 22 of the first reducer lens 20 and the incident surface 26 of the second reducer lens 25 and the light B may be incident on the incident surface 26 of the second reducer lens 25.

The light which is incident on the incident surface 26 of the second reducer lens 25 may transmit through the second reducer lens 25 and thus may be emitted through the emitting surface 27 of the second reducer lens 25 in parallel.

In other words, the light A emitted from the light source 10 sequentially transmits through the first reducer lens 20, the air between the first reducer lens 20 and the second reducer lens 25, and the second reducer lens 25 and thus the width of the light is reduced, and the light C of which the width is reduced may be incident on the reflecting unit 2.

The light C which is incident on the reflecting unit 2 is reflected at the reflecting unit 2 and the reflected light D may be incident on the incident surface 61 of the prism 6. In a case where the prism 6 includes the first condensing lens, the reflected light D may be incident on the convex surface of the first condensing lens.

The light E which is incident on the prism 6 is totally reflected from the inner portion of the prism passes through the prism 6. The total reflection may occur in plural number of times according to the incident angle of light or the length of the prism 6.

The light F passed through the prism 6 may be emitted to the emitting surface 62 of the prism 6. In a case where the prism 6 includes the second condensing lens, the emitted light D may be emitted to the convex surface of the second condensing lens.

The light F emitted from the emitting surface of the prism 6 may be incident on the reflective fluorescent body 4. The wavelength of the light which is incident on the reflective fluorescent body 4 may be changed by the reflective fluorescent body 4 and the white based light F may be irradiated to the rear surface 32 of the lens 3 in the reflective fluorescent body 4.

The light irradiated to the rear surface 32 of the lens 3 in the reflective fluorescent body 4 may transmit through the lens 3, and the light G transmits through the front surface 31 of the lens 3 and then may be incident on the projection lens 5 through the rear surface 52 of the projection lens 5.

The light which is incident on the projection lens 5 transmits through the projection lens 5, is refracted at the front surface 51 of the projection lens 5 and thus may be emitted to the front side of the projection lens 5 in parallel.

The light H emitted to the front side of the projection lens 5 may be irradiated in the front side of the vehicle.

Although implementations have been described with reference to a number of illustrative implementations thereof, it should be understood that numerous other modifications and implementations can be devised by those skilled in the art that will fall within the spirit and scope of the principles of this disclosure.

Accordingly, implementations disclosed herein are for illustrating but not for limiting the technical scope of the present disclosure, the scope of the technical spirits of the present disclosure is not limited by the implementations disclosed herein.

What is claimed is:

1. A lighting device for a vehicle, comprising:

a lens;

a prism that is disposed on a rear side of the lens and that is configured to totally reflect an incident light and to then emit the light;

a light source device configured to emit light toward the prism; and a reflective fluorescent body disposed on the rear side of the lens and configured to convert a wavelength of light emitted by the prism and to then reflect the wavelength-converted light to the lens, wherein the prism comprises an emitting surface that does not intersect an optical axis of the lens, wherein a distance between the reflective fluorescent body and a rear surface of the lens is greater than a distance between the emitting surface of the prism and the rear surface of the lens, and wherein the prism comprises:

an incident surface on which light is incident; and an emitting surface from which light is emitted, wherein the incident surface is perpendicular to the rear surface of the lens.

2. The lighting device according to claim 1, wherein the reflective fluorescent body is disposed to face the rear surface of the lens and is configured to reflect the light toward the rear surface of the lens.

3. The lighting device according to claim 1, wherein the reflective fluorescent body is disposed on the optical axis of the lens.

4. The lighting device according to claim 1, wherein at least one portion of the prism is disposed between the reflective fluorescent body and the lens.

5. The lighting device according to claim 1, wherein a sectional surface of the prism has a circular shape.

6. The lighting device according to claim 1, wherein a sectional surface of the prism has a polygonal shape having at least one pair of parallel sides.

7. The lighting device according to claim 1, wherein the prism has a length that is configured for the prism to totally reflect, a plural number of times, light that is incident on the prism.

8. The lighting device according to claim 1, wherein the emitting surface is perpendicular to the rear surface of the lens.

9. The lighting device according to claim 1, wherein the incident surface and the emitting surface are parallel to each other.

10. The lighting device according to claim 1, further comprising a convex lens configured to condense light, the convex lens provided on at least one surface of the incident surface and the emitting surface.

11. The lighting device according to claim 1, further comprising an anti-reflection (AR) coating on at least one surface of the incident surface and the emitting surface.

12. The lighting device according to claim 1, wherein a distance between the optical axis of the lens and the emitting surface is less than or equal to a radius of the rear surface of the lens.

* * * * *